US010895056B2

(12) United States Patent
Choi et al.

(10) Patent No.: US 10,895,056 B2
(45) Date of Patent: Jan. 19, 2021

(54) SHIELDING APPARATUS FOR HIGH-DEPTH GROUNDWATER WELL POLLUTION PREVENTION GROUTING

(71) Applicant: G&G Technology Co., Ltd., Incheon (KR)

(72) Inventors: Sung Ouk Choi, Incheon (KR); Sang Gin Park, Incheon (KR); Heuy Nam Cho, Incheon (KR)

(73) Assignee: G&G Technology Co., Ltd., Incheon (KR)

( * ) Notice: Subject to any disclaimer, the term of this patent is extended or adjusted under 35 U.S.C. 154(b) by 0 days.

(21) Appl. No.: 16/221,985

(22) Filed: Dec. 17, 2018

(65) Prior Publication Data

US 2020/0165793 A1 May 28, 2020

(30) Foreign Application Priority Data

Nov. 28, 2018 (KR) ..... 10-2018-0149615

(51) Int. Cl.
*E02D 31/00* (2006.01)
*E03B 3/15* (2006.01)
(Continued)

(52) U.S. Cl.
CPC ..... *E02D 31/004* (2013.01); *E02D 19/18* (2013.01); *E02D 31/10* (2013.01); *E03B 3/15* (2013.01)

(58) Field of Classification Search
CPC combination set(s) only.
See application file for complete search history.

(56) References Cited

U.S. PATENT DOCUMENTS 3,066,739 A * 12/1962 Sauren ..... E21B 33/1275 166/141
3,952,799 A * 4/1976 Simpson ..... E21B 21/00 166/116

(Continued)

FOREIGN PATENT DOCUMENTS

JP 3271431 A 12/1991
JP 2007169893 A 7/2007

(Continued)

OTHER PUBLICATIONS

Office action in corresponding Korean application 9-5-2020-036583913 dated May 27, 2020, (pp. 1-5) and english translation (pp. 1-4).

*Primary Examiner* — Kyle Armstrong
(74) *Attorney, Agent, or Firm* — Millen, White, Zelano & Branigan, P.C.; William Nixon

(57) ABSTRACT

Disclosed is a shielding apparatus for high-depth groundwater well pollution prevention grouting comprising: a shielding portion which is provided on the outer circumferential surface of a grouting casing installed in an excavation hole in the ground and compressed to be in close contact with a hollow wall of the excavation hole; a compression portion which is provided on the outer circumferential surface of the grouting casing and formed to descend toward the shielding portion and brings the shielding portion into close contact with the hollow wall of the excavation hole to guide the excavation hole to be sealed; and a pressure equalization injection tube portion which is connected with the compression portion on the outer circumferential surface of the grouting casing and lowers the compression portion by water pressure generated by supplying water from the outside through a water supply tube.

14 Claims, 8 Drawing Sheets

(51) Int. Cl.
*E02D 31/10* (2006.01)
*E02D 19/18* (2006.01)

(56) References Cited

U.S. PATENT DOCUMENTS

| | | | | |
|---|---|---|---|---|
| 5,275,505 | A * | 1/1994 | Wilcox | B63C 3/06 114/44 |
| 2005/0161232 | A1* | 7/2005 | Patel | E21B 33/128 166/386 |
| 2012/0211221 | A1* | 8/2012 | Mills | E21B 23/04 166/180 |
| 2014/0318812 | A1* | 10/2014 | Moyes | E21B 33/128 166/381 |

FOREIGN PATENT DOCUMENTS

| | | | |
|---|---|---|---|
| KR | 19990068763 | A | 9/1999 |
| KR | 20020020518 | A | 3/2002 |
| KR | 101131123 | B1 | 3/2012 |
| KR | 101912245 | B1 | 10/2018 |

* cited by examiner

SHIELDING APPARATUS FOR HIGH-DEPTH GROUNDWATER WELL POLLUTION PREVENTION GROUTING

TECHNICAL FIELD

The present invention relates to a shielding apparatus for high-depth groundwater well pollution prevention grouting, and more particularly, to a shielding apparatus for high-depth groundwater well pollution prevention grouting to block the inflow of polluted groundwater from the upper part of a groundwater excavation hole (groundwater well, groundwater quality measurement network, geothermal soil heat exchanger excavation hole, etc.), or to shield a section for blocking polluted groundwater for a section where turbidity or a pollutant is extensively introduced due to some pollution.

BACKGROUND ART

In general, surface water such as lakes, artificial lakes through construction of dam, streams and rivers has already been predicted to be depleted due to the explosive increase in human water use, and Korea is also classified as a future water famine nation.

As a result, groundwater is being illuminated as a new water resource for future humans, and the usage rate of groundwater in South Korea tends to be continuously on the rise, and its usage rate is close to 12% of the total water use. However, it can be predicted that the domestic groundwater use ratio will increase continuously and exceed 20%, and thus it has been analyzed that the development potential of about 6 billion tons, which is more than 2.5 times that of current groundwater use, has been held.

However, as one of the country's important underground resources, groundwater that will be passed down to future generations is not properly managed in the process of development and use to be depleted, and is being devastated by indiscriminate excavation resulting from redevelopment, and thus it is not too much to say that it is a national disaster.

In order to conserve the groundwater quality by preventing the inflow of the upper polluted groundwater in the process of forming the excavation hole for a groundwater deep well, a water quality measurement network, or a geothermal soil heat exchanger in the related art, it is regulated and implemented to insert a lower surface protection wall (casing) up to a depth of 1 m or more and form a barrier wall with a thickness or 5 cm or more.

At this time, when the compressed air is injected into a shielding apparatus which has been used, an expanded expansion tube is connected to the lower end of the casing to be inserted to the target depth, and compressed air is injected to shield a gap between a hollow wall of the excavation hole and the casing and then a rapid hardening cement is injected and hardened promptly to achieve effective shielding.

In addition, other shielding apparatus shielded the gap between the hollow wall of the excavation hole and the casing while a cylindrical compression tube capable of being deformed by compressing is inserted between casings that can slide with each other and then lowered to a target depth, and the shape of the compression tube is shrunk in the process of contracting while the casings slide with each other by releasing and then compressing a safety lock device.

Such a shape has an effect capable of effectively shielding both the casings and the hollow wall of the excavation hole.

However, in the case of the expansion tube, the expansion tube is frequently damaged in the process of being inserted into the excavation hole, and thus there is a problem in that workability is largely deteriorated, and in the case of the compression tube, there is a problem in that the lower end of the casing is located at the bottom of the excavation hole in the process of compressing and sliding the casing to be supported or a rope for holding a separate casing needs to be installed.

Meanwhile, as a prior art related to the present invention, many patents and utility models in addition to Korean Patent Registration No. 0334451 (title of the invention: grouting pipe apparatus and grouting method of deep groundwater well) invented and patented by the present inventor have been filled and registered, and have contributed to the development of national groundwater and pollution prevention related fields by achieving successful technology integration and commercialization in the field.

In the related art, it is possible to ensure high shielding efficiency even at various intervals between a wall of the deep groundwater well and an outer circumferential surface of the grouting casing, and thus, the related art is recognized as a new technology due to its high evaluation of the superiority of the technology and has been listed in the National Guideline for Groundwater Operations, and of course, in Jeju Island, there is also the enforcement of the application through the enactment of the special law.

However, as described above, it is necessary to inject compressed air in order to expand the expansion tube due to the characteristic, and in the process of injecting the compressed air into the grouting casing from the ground surface to a depth of 30 m or less, there is always a possibility to be broken due to friction and impact with the wall of the deep groundwater well having a narrow gap in which the grouting thickness defined by the groundwater law is only 50 millimeters (mm).

In addition, when the expansion tube is injected and expanded with water due to a characteristic of being installed vertically, there is a problem that it is difficult to adjust or secure accurately a planned expansion force due to a groundwater level which is not uniform every deep groundwater well by a water head pressure phenomenon (generation of a pressure of about 1.033 kg/cm2 per 10 meters of water height). In order to solve the inconvenience, the compressed air is used, and since the pressure of the compressed air needs to be determined as an appropriate supply air pressure by considering the water head pressure at a depth obtained by subtracting the groundwater level from the installation depth of the expansion tube because the expansion tube starts to be expanded even at 0.1 kg/cm or more due to the high flexible expansion, it is confirmed that it is difficult for beginners who first experience the apparatus to handle the apparatus and there are difficulties in understanding the technology and the spot adoption in the process of directly supplying and constructing to the groundwater development company which is more concerned with the practice than the theory. For these reasons, there is no choice but to have a limitation in application to a wider range of technologies.

Further, in Korean Patent Registration No. 10-0715746 (title of the invention: grouting apparatus for preventing pollution of deep groundwater well and method of constructing the same), there is invented an apparatus of configuring a lower surface protection wall so that the polluted surface water is not introduced to the deep groundwater well and a constructing method. The apparatus and the method are configured by an apparatus including an annular mounting plate to shield a lower surface of a gap between incasing and outcasing, an inner packing and an outer packing which are seated on the upper surface of the mounting plate and configured to be in close contact with an incasing outer circumferential surface and an outcasing inner circumference when a separation distance is increased as a divided structure, respectively, and a control means for controlling the separation distance between the inner packing and the outer packing.

However, there is a problem in that there is no choice but to have a limitation in that the inner packing and the outer packing can not exhibit the function in a narrow space between the incasing used for grouting and the groundwater excavation hollow wall, and there is no choice but to have inconvenience to adjust thickness values of the inner packing and the outer packing depending on a size of the gap between the incasing and the groundwater excavation hollow wall. In addition, in order to insert a wedge member, there is no choice but to limit heights of the inner packing and the outer packing, and as a result, as the length of the shielding is shortened, the shielding area becomes small, so that it is inevitably insufficient to ensure effective shielding performance.

More importantly, there is no consideration as to how to operate the wedge member, which is the control means for controlling the separation distance between the inner packing and the outer packing, in the gap between the incasing formed narrowly at about 50 millimeters and the groundwater excavation hollow wall.

DISCLOSURE

Technical Problem

An object of the present invention is to provide a shielding apparatus for high-depth groundwater well pollution prevention grouting, in which a shielding body expanded by compression for forming a barrier layer is included and the cylinder descends along the outer circumferential surface of the grouting casing by the water pressure to compress the shielding body and uniformly expand the entire part of the shielding body by expansion by the compression, and as a result, it is possible to block the inflow of the polluted groundwater introduced from the upper layer of the groundwater excavation hole (a groundwater well, a groundwater quality measurement network, a geothermal soil heat exchanger excavation hole, etc.) or to enable reliable section shielding to block the polluted groundwater for the section into which turbidity or pollutants are intensively introduced by some pollution.

Technical Solution

An aspect of the present invention provides a shielding apparatus for high-depth groundwater well pollution prevention grouting comprising: a shielding portion which is provided on the outer circumferential surface of a grouting casing installed in an excavation hole in the ground and compressed to be in close contact with a hollow wall of the excavation hole; a compression portion which is provided on the outer circumferential surface of the grouting casing and formed to descend toward the shielding portion and brings the shielding portion into close contact with the hollow wall of the excavation hole to guide the excavation hole to be sealed; and a pressure equalization injection tube portion which is connected with the compression portion on the outer circumferential surface of the grouting casing and lowers the compression portion by water pressure generated by supplying water from the outside through a water supply tube.

The compression portion may include a pressing plate which is provided on the outer circumferential surface of the grouting casing so as to face the upper surface of the shielding portion and has a plurality of engaging grooves formed along the edge; and a cylinder which is engaged with the engaging groove to be connected to the pressure equalization injection tube portion and formed to lower the pressing plate by the water pressure by supplying the water supplied to the pressure equalization injection tube portion to the inside.

Here, the compression portion may further include a control valve which is provided on a connection tube connecting the pressure equalization injection tube portion and the cylinder and controls the opening and closing so that the plurality of cylinders descend at the same water pressure by supplying the water stored in the pressure equalization injection tube portion toward the cylinder at the same time and the same amount.

In addition, the shielding apparatus for high-depth groundwater well pollution prevention grouting may further include an ascending blocking portion which is fixedly disposed between the plurality of cylinders with respective lengths and disposed to be in contact with the upper edge of the pressing plate to block the ascending of the pressing plate.

Here, the compression portion may further include guide members which make a pair to be engaged in plural on the upper portion of the pressing plate so as to be in contact with both surfaces of the ascending blocking portion and guide a descending path when the pressing plate descends.

In addition, the pressing plate may include a fastening hole which is provided at the edge of the position where the engaging groove is formed and formed to be engaged with the cylinder by inserting the fastening member to the side surface as a piston rod constituting the cylinder is engaged with the engaging groove.

In addition, the pressing plate may include a receiving member which is formed such that the edge of the outer circumferential surface is bent downward toward the shielding portion, and formed so as to selectively receive the shielding portion therein.

In addition, the grouting casing may include a plurality of groove members formed along the outer circumferential surface facing the pressing plate, and the pressing plate may include protrusion members to be inserted into the groove members so that the protrusion member is rail-engaged with the inside of the groove member to descend.

Here, the inner circumferential surface of the groove member forming a descending section of the pressing plate may be formed in the form of a ratchet gear, and the protrusion member may be fitted with the inner circumferential surface of the groove member so as to limit the ascending of the pressing plate.

Meanwhile, the pressure equalization injection tube portion may include an air discharge tube formed to discharge the remaining internal air to the outside before the water is supplied through the water supply tube.

The air discharge tube may include a shutoff valve formed to be opened when the remaining air is discharged and selectively shut off as the water is supplied to the inside of the pressure equalization injection tube portion.

In addition, the shielding portion may be made of a soft rubber material so that the shape of the shielding portion is deformed as the compression portion descends to be selectively brought into close contact with the hollow wall of the excavation hole.

Advantageous Effects

According to the present invention, a shielding body expanded by compression for forming a barrier layer is included and the cylinder descends along the outer circumferential surface of the grouting casing by the water pressure to compress the shielding body and uniformly expand the entire part of the shielding body by expansion by the compression. As a result, it is possible to block the inflow of the polluted groundwater introduced from the upper layer of the groundwater excavation hole (a groundwater well, a groundwater quality measurement network, a geothermal soil heat exchanger excavation hole, etc.) or to enable reliable section shielding to block the polluted groundwater for the section into which turbidity or pollutants are intensively introduced by some pollution.

Further, since the shielding body made of a synthetic resin instead of a conventional expansion tube is applied to the present invention, it is possible to prevent a problem of deterioration of a shielding function due to damage such as tearing, and thus, largely improve reliability of the quality and the construction of the product.

MODES OF THE INVENTION

Hereinafter, preferred embodiments of the present invention will be described in detail with reference to the accompanying drawings.

Advantages and features of the present disclosure, and methods for accomplishing the same will be more clearly understood from exemplary embodiments described in detail below with reference to the accompanying drawings.

However, the present invention is not limited to the embodiments set forth below, and will be embodied in various different forms. The present embodiments are just for rendering the disclosure of the present invention complete and are set forth to provide a complete understanding of the scope of the invention to a person with ordinary skill in the technical field to which the present invention pertains, and the present invention will only be defined by the scope of the claims.

In the following description of the present invention, a detailed description of known arts related thereto will be omitted when it is determined to make the subject matter of the present invention rather unclear.

Figure 1:
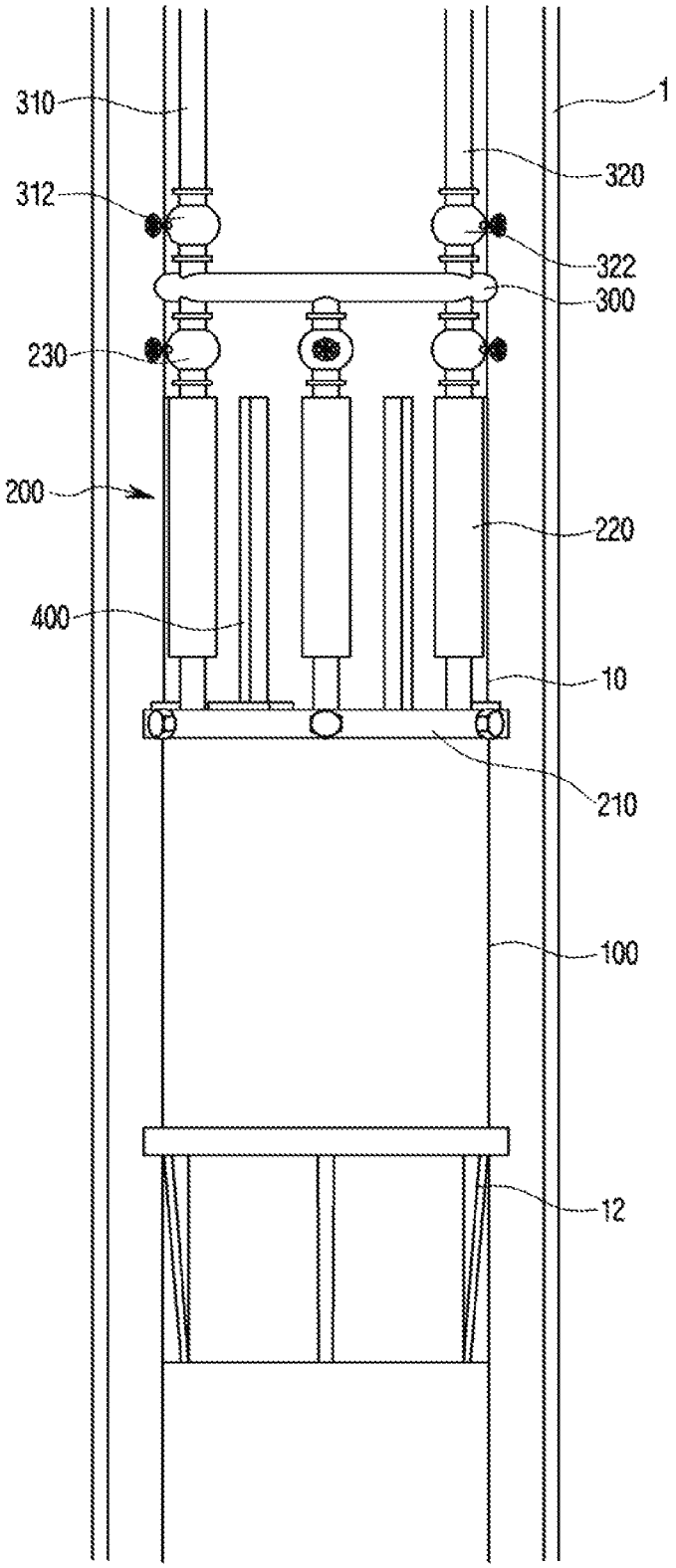
FIG. 1 is a schematic view illustrating a shielding apparatus for high-depth groundwater well pollution prevention grouting according to an embodiment of the present invention.
Figure 2:
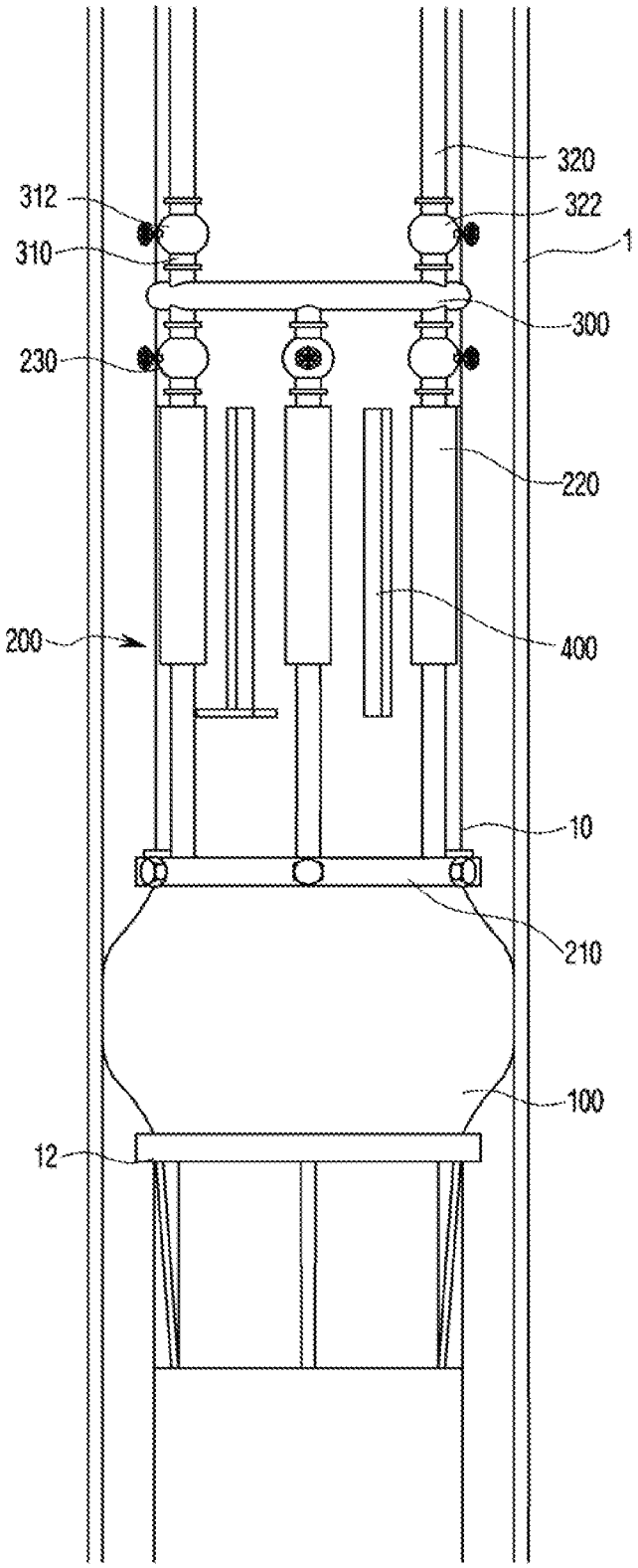
FIG. 2 is a schematic view illustrating an operation of the shielding apparatus for high-depth groundwater well pollution prevention grouting according to the embodiment of the present invention.
Figure 3:
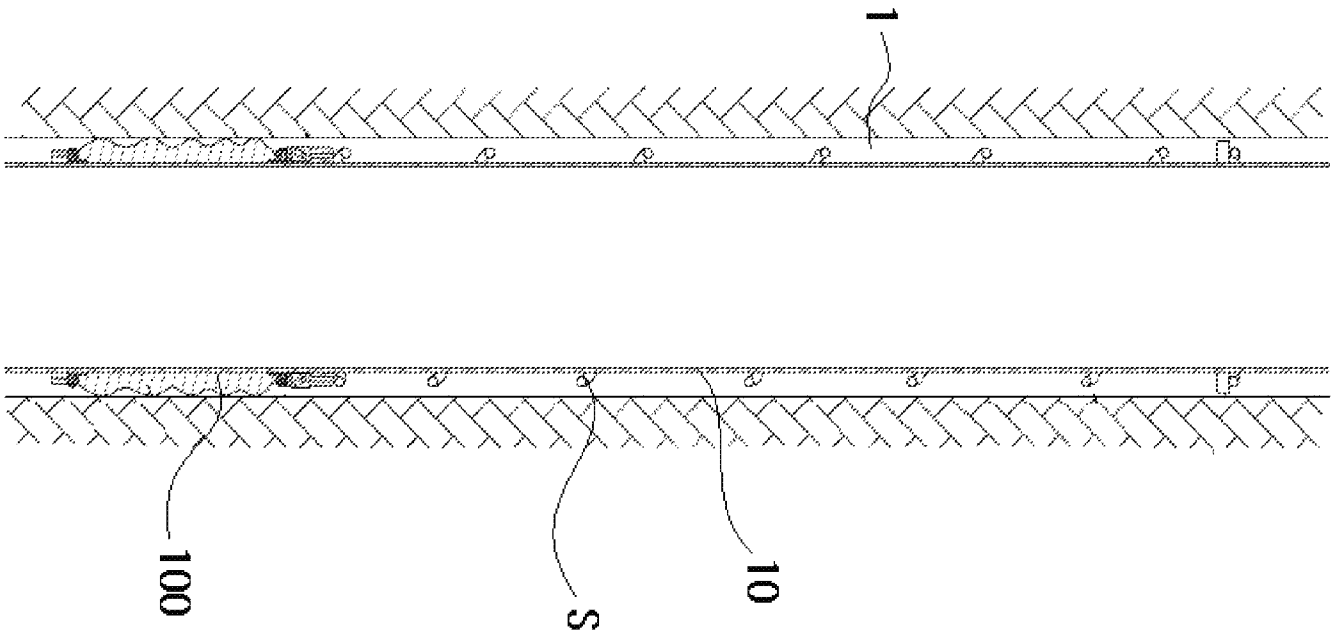
FIG. 3 is a schematic view illustrating a conventional structure of the shielding apparatus for high-depth groundwater well pollution prevention grouting according to the embodiment of the present invention.

FIG. 1 is a schematic view illustrating a shielding apparatus for high-depth groundwater well pollution prevention grouting according to an embodiment of the present invention, FIG. 2 is a schematic view illustrating an operation of the shielding apparatus for high-depth groundwater well pollution prevention grouting according to the embodiment of the present invention, and FIG. 3 is a schematic view illustrating a conventional structure of the shielding apparatus for high-depth groundwater well pollution prevention grouting according to the embodiment of the present invention.

As illustrated in FIG. 1, the shielding apparatus for high-depth groundwater well pollution prevention grouting according to the present embodiment is mounted on an outer circumferential surface of a grouting casing 10 which is inserted into an excavation hole 1 in the ground (which means all holes formed in the ground such as an excavation hole for pumping groundwater, that is, covers all used holes drilled in the ground), and includes a shielding portion 100, a compression portion 200, and a pressure equalization injection tube portion 300.

The shielding portion 100 is provided on the outer circumferential surface of the grouting casing 10 installed in the excavation hole 1 in the ground and compressed to be in close contact with a hollow wall of the excavation hole 1.

Preferably, the shielding portion 100 is made of a soft rubber material so that the shape of the shielding portion 100 is deformed as the compression portion 200 descends and is selectively brought into close contact with the hollow wall of the excavation hole 1.

The shielding portion 100 is seated on a guide plate 12 fixed to protrude from the outer circumferential surface of the grouting casing 10 so that the position thereof may be fixed by the compression portion 200 in a region between the guide plate 12 and the shielding portion 100.

The compression portion 200 is provided on the outer circumferential surface of the grouting casing 10 and formed to descend toward the shielding portion 100 and brings the shielding portion 100 into close contact with the hollow wall of the excavation hole 1 to guide the excavation hole 1 to be sealed.

Herein, the compression portion 200 is formed to descend by water pressure generated by supplying water to the inside by the pressure equalization injection tube portion 300.

Meanwhile, the pressure equalization injection tube portion 300 is connected with the compression portion 200 while being fixed to the outer circumferential surface of the grouting casing 10 and formed to descend by water pressure generated by supplying water to the outside through a water supply tube 310.

That is, in the pressure equalization injection tube portion 300, while the water is supplied to the inside through the water supply tube 310 to be received therein, when a plurality of connection tubes 302 connected to the compression portion 200 are simultaneously opened, the shielding portion 100 is compressed by descending of the compression portion 200 to be brought into close contact with the hollow wall of the excavation hole 1.

Conventionally, as illustrated in FIG. 3, the shielding portion 100 is compressed to be brought into close contact with the hollow wall of the excavation hole 1 by pressing a spring S, not the structure of a cylinder according to the present embodiment. However, in the case of such a structure, since it is difficult for the compression portion 200 to be horizontally maintained and descend due to the structural characteristic of the spring S, it is difficult to uniformly transmit the elastic force to the entire area of the upper surface of the shielding portion 100 and thus, it is difficult to bring the shielding portion 100 into close contact with the hollow wall of the excavation hole 1.

Accordingly, in the present embodiment, the compression portion 200 formed in the cylindrical structure descends along the outer circumferential surface of the grouting casing 10 by the water pressure formed by a water pressure pump to compress the shielding portion 100 and uniformly expand all parts of the shielding portion 100 by the expansion caused by the compression. As a result, it is possible to block the inflow of the polluted groundwater introduced from the upper layer of the groundwater excavation hole 1 (a groundwater well, a groundwater quality measurement network, a geothermal soil heat exchanger excavation hole, etc.) or to enable reliable section shielding to block the polluted groundwater for the section into which turbidity or pollutants are intensively introduced by some pollution.

Figure 4:
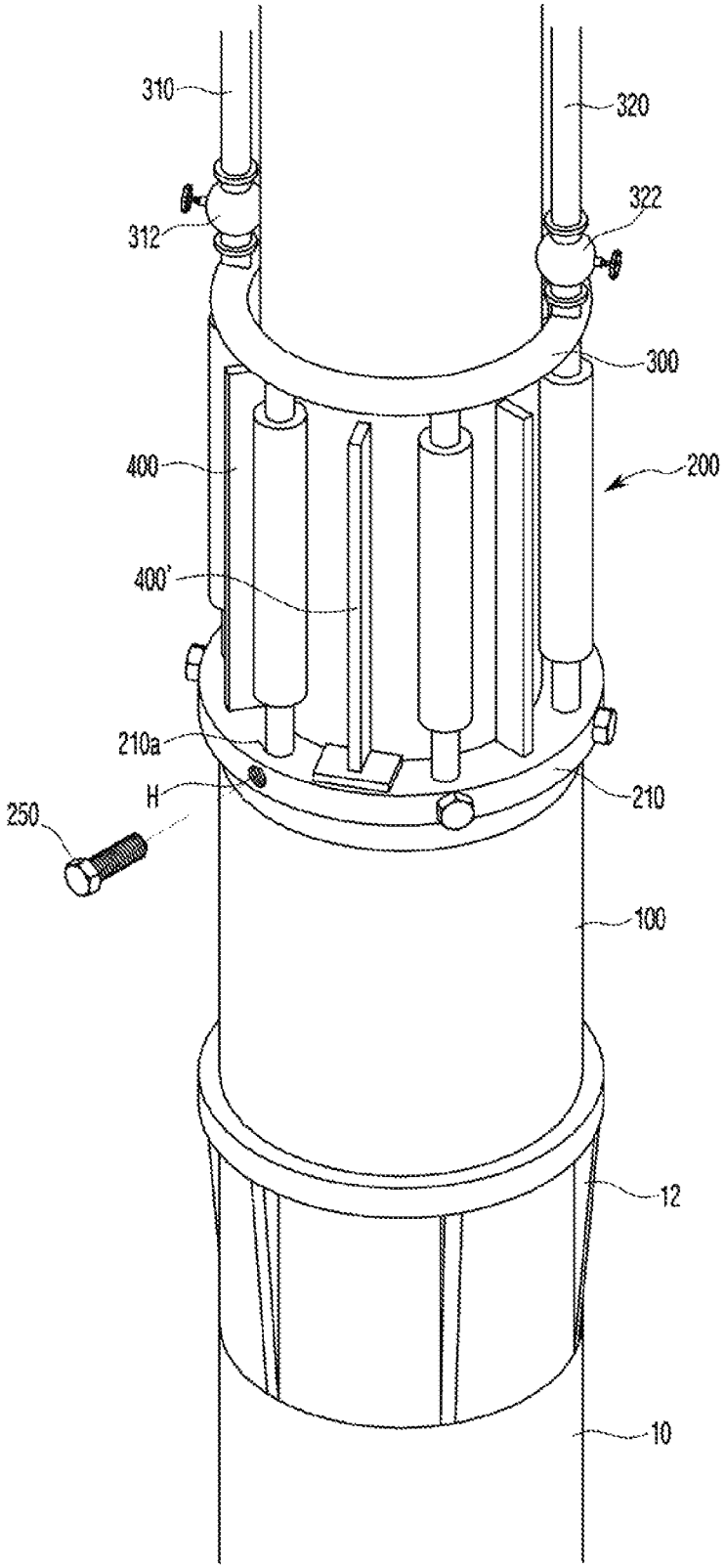
FIG. 4 is a view illustrating a structure of a compression portion and a pressure equalization injection tube portion of the shielding apparatus for high-depth groundwater well pollution prevention grouting according to the embodiment of the present invention.
Figure 5:
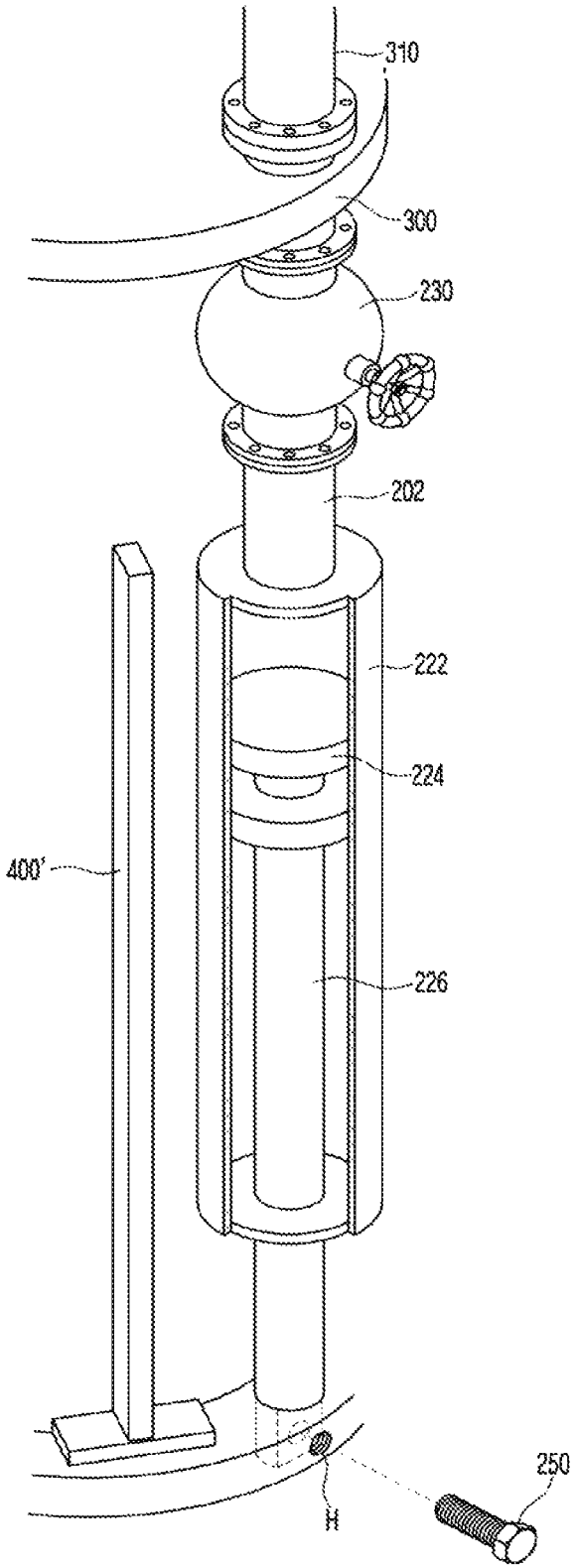
FIG. 5 is a view illustrating a structure of a cylinder of the shielding apparatus for high-depth groundwater well pollution prevention grouting according to the embodiment of the present invention.
Figure 6:
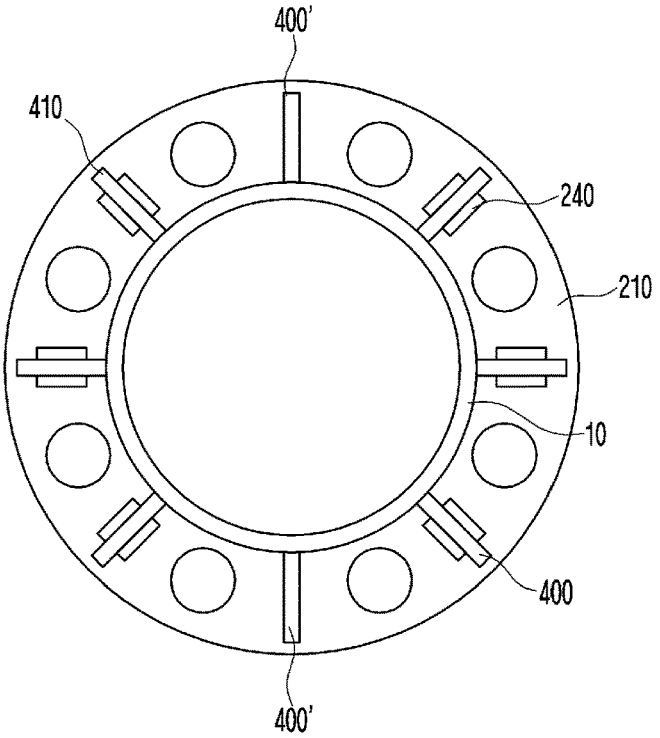
FIG. 6 is a view illustrating a guide member of the shielding apparatus for high-depth groundwater well pollution prevention grouting according to the embodiment of the present invention.

Hereinafter, FIG. 4 is a view illustrating a structure of a compression portion and a pressure equalization injection tube portion of the shielding apparatus for high-depth groundwater well pollution prevention grouting according to the embodiment of the present invention, FIG. 5 is a view illustrating a structure of a cylinder of the shielding apparatus for high-depth groundwater well pollution prevention grouting according to the embodiment of the present invention, and FIG. 6 is a view illustrating a guide member of the shielding apparatus for high-depth groundwater well pollution prevention grouting according to the embodiment of the present invention.

As illustrated in FIG. 4, the shielding apparatus for high-depth groundwater well pollution prevention grouting according to the present embodiment includes the compression portion 200, and the compression portion 200 includes a pressing plate 210 and a cylinder 220.

First, the pressing plate 210 is provided on the outer circumferential surface of the grouting casing 10 so as to face the upper surface of the shielding portion 100 and has a plurality of engaging grooves 210*a* for engaging the cylinder 220 along the edge.

The pressing plate 210 has a fastening hole H for fixing the position thereof while the cylinder 220, that is, a piston rod 226 constituting the cylinder 220 is inserted into the engaging groove 210*a*.

Herein, the fastening hole H is provided at the edge of the pressing plate 210 corresponding to the position where the engaging groove 210*a* is formed and engaged with the piston rod 226 to guide the fastening member 250 to be inserted to the side surface so as to be firmly engaged to the cylinder 220.

The cylinder 220 is engaged with the engaging groove 210*a* to be connected to the pressure equalization injection tube portion 300 and formed to lower the pressing plate 210 by water pressure when the water stored in the pressure equalization injection tube portion 300 is supplied to the inside.

The structure of the cylinder 220 is a general cylinder structure including a cylinder 222, a piston 224 and a piston rod 226, and the plurality of cylinders is engaged with each other along the edge of the pressure plate 210 to be connected to the pressure equalization injection tube portion 300 in the vertical direction.

All of the plurality of cylinders 220 connected to the pressure equalization injection tube portion 300 descend at the same pressure to uniformly compress the entire area of the shielding portion 100 through the pressing plate 210, and as illustrated in FIG. 5, includes a control valve 230.

That is, the control valve 230 is installed in the connection tube 202 connecting the pressure equalization injection tube portion 300 and the cylinder 220 so that water supplied to the pressure equalization injection tube portion 300 is supplied toward the cylinder 220 at the same time and the same amount to control the opening and closing so that the plurality of cylinders 220 descend at the same water pressure.

In other words, the control valve 230 is maintained in the closed state in the early stage, and thereafter, in the case of compressing the shielding portion 100 by lowering the pressing plate 210, when it is checked that a predetermined amount of water is received inside the pressure equalization injection tube portion 300, the operation of the control valve 230 is controlled to simultaneously open the plurality of connection tubes 202 so that the plurality of cylinders 220 is maintained in the horizontal state by the same water pressure, that is, may descend along the same descending height.

At this time, the supplying of the water to the inside of the cylinder 220 in order to lower the cylinder 220 by water pressure is to prevent occurrence of such a problem because if the cylinder 220 is broken due to a weakened hollow wall of the excavation hole 1, in the case of supplying and using hydraulic oil as a fluid to the inside of the cylinder 220, the fluid flows out to pollute the inside of the excavation hole 1.

Meanwhile, the operation of the pressing portion 200 will be sequentially described below based on the configuration of the pressing portion 200 illustrated in FIG. 4.

First, the water is supplied to the inside of the pressure equalization injection tube portion 300 from the outside through the water supply tube 310, and at this time, an air discharge tube 320 formed to discharge remaining internal air before water is supplied through the water supply tube 310 is provide in the pressure equalization injection tube portion 300 to discharge the remaining air in the pressure equalization injection tube portion 300 to the outside by the injected water while supplying the water, thereby smoothly supplying the water.

The reason for such a process is that when the natural water level is lowered as water is filled in the water supply tube 310 from the initial stage of installation, the water head of the water supply tube 310 may be formed to be high, and in order to prevent the problem that the compression portion 200 is unintentionally driven at an undesired depth due to the water head so as not to achieve the purpose of the shielding, the supply of water is limited to an appropriate depth at the initial stage of installation.

Subsequently, when the water supply is started, a shutoff valve 322 provided in the air discharge tube 320 is shut off, and when a predetermined amount of water for the descending of the cylinder 220 is received to the inside of the pressure equalization injection tube portion 300 as the water supply progresses, a check valve 312 of the water supply tube 310 is also controlled to be shut off.

Here, the check valve 312 functions to prevent the pressing plate 210 from ascending by flowing backward water supplied after the cylinder 220 descends to the inside of the pressure equalization injection tube portion 300 by the first supplied water pressure.

Thereafter, the operation of the control valve 230 is controlled so that the control valve 230 provided in the connection tube 202 connecting the plurality of cylinders 220 and the descending guide 300 is opened, and the water in the descending guide 200 moves to the inside of each cylinder portion 222 through the plurality of connection tubes 202 at the same time so that the pressing plate 210 is maintained at the same speed and in the horizontal state by the same water pressure and guided to descend.

In more detail, when a plurality of control valves 230 provided in the connection tube 202 are all opened, the piston 224 descends in the cylinder portion 222 by the same water pressure generated by supplying the water received in the descending guide 300, and as a result, the pressing plate 210 engaged with the piston rod 226 through the fastening member 250 descends by the descending of the piston rod 226 while maintaining the horizontal state toward the shielding portion 100 to compress the shielding portion 100, thereby firmly sealing the excavation hole 1 through the modified shielding portion 100.

The control valve 230 may be installed by setting an opening/closing operation pressure in advance, and may be omitted if necessary.

In this state, a filling material such as cement is supplied through a grouting injection tube (not illustrated) into a space between the hollow wall inside the excavation hole 1 sealed by the shielding portion 100 and the grouting casing 10, so that the inside of the excavation hole 1 is in a closed state, thereby preventing upper polluted groundwater from flowing into the inside of the grouting casing 10.

Meanwhile, as illustrated in FIG. 4, the shielding apparatus for high-depth groundwater well pollution prevention grouting according to the present embodiment further includes an ascending blocking portion 400, and the ascending blocking portion 400 is fixedly disposed between the plurality of cylinders 220 with respective lengths and disposed to be in contact with the upper edge of the pressing plate 210 to block the ascending of the pressing plate 210.

The ascending blocking portion 400 is formed by two types, in which one ascending blocking portion 400' is formed so that one end facing the upper edge of the pressing plate 210 has a predetermined area to efficiently block the pressing plate 210 which ascends by reaction or pressure due to elasticity as the shielding portion 100 is modified when the pressing plate 210 descends, and the other ascending blocking portion 400 may guide a descending path of the pressing plate 210 together with a guide member 240 to be described below.

That is, the ascending blocking portions 400 and 400' are installed between the plurality of cylinders 220, respectively, and in the case where one end is the ascending blocking portion 400' having a predetermined area, the guide member 240 to be described below is installed to generate interference, and thus only a pair of guide members 240 facing each other may be provide on the outer circumferential surface of the grouting casting 10.

Meanwhile, as illustrated in FIGS. 4 and 6, the guide members 240 make a pair and engaged in plural at the upper portion of the pressing plate 210 so as to be in contact with both surfaces of the other ascending blocking portion 400 except for the ascending blocking portion 400' of which one end of the two types has a predetermined area, respectively.

Accordingly, the guide members 240 may guide a descending path when the pressing plate 210 descends, and as a result, when the pressing plate 210 descends by water pressure, the guide member 240 having the predetermined length descends along the ascending blocking portion 400 to guide the pressing plate 210 to descend while easily maintaining the same horizontal state.

Figure 7:
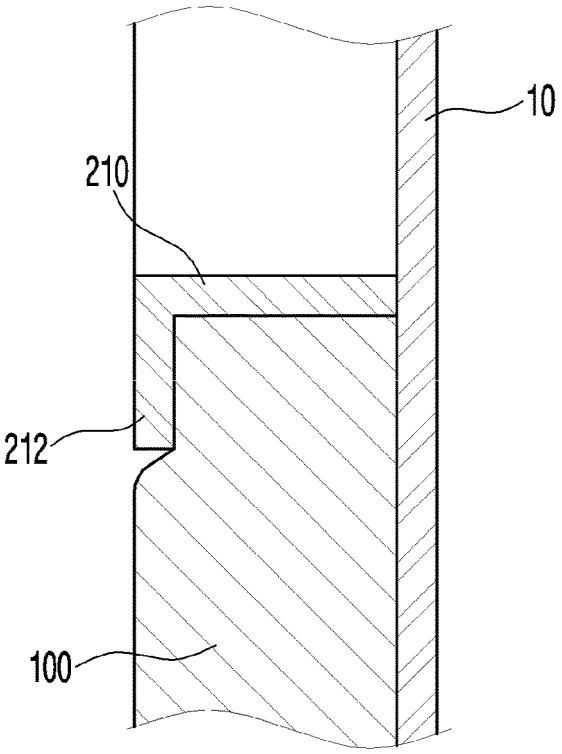
FIG. 7 is a view illustrating a structure of a receiving member of the shielding apparatus for high-depth groundwater well pollution prevention grouting according to the embodiment of the present invention.

Hereinafter, FIG. 7 is a view illustrating a structure of a receiving member of the shielding apparatus for high-depth groundwater well pollution prevention grouting according to the embodiment of the present invention.

As illustrated in FIG. 7, the shielding apparatus for high-depth groundwater well pollution prevention grouting according to the present embodiment may include a pressing plate 210 for compressing the shielding portion 100 and the pressing plate 210 may include a receiving member 212.

That is, the receiving member 212 is formed such that the edge of the outer circumferential surface is bent downward toward the shielding portion 100, and formed so as to selectively receive the shielding portion 100 therein.

In other words, the receiving member 212 is formed to be bent on the outer circumferential surface of the pressing plate 210, and if the pressing plate 210 descends to compress the shielding portion 100, since the diameter of the pressing plate 210 is smaller than the internal diameter of the excavation hole 1, a part of the modified shielding portion 100 may be discharged through the space therebetween by the pressure, and thus the receiving member 212 is installed on the outer circumferential surface of the pressing plate 210, thereby preventing the problem such as the discharge of the shielding portion 100.

Here, it is illustrated that the receiving member 212 is bent at an angle of 90° on the outer circumferential surface of the pressing plate 210, but this is merely one example. In order to effectively block the discharge of the shielding portion 100, the receiving member 212 may be formed to be inclined downward from the outer circumferential surface of the pressing plate 210 toward the inside of the excavation hole 1.

Figure 8:
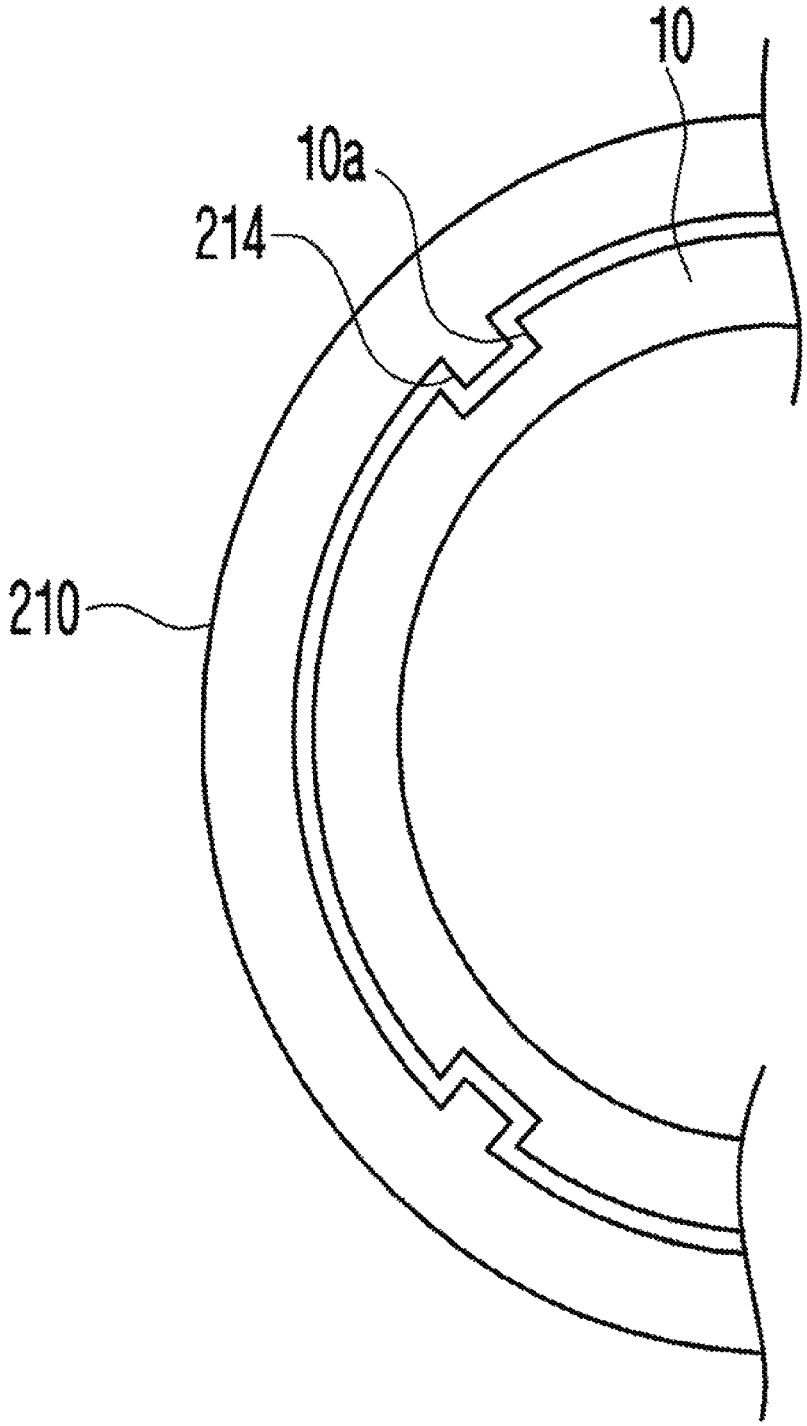
FIG. 8 is a view illustrating rail coupling a groove member and a protrusion member of the shielding apparatus for high-depth groundwater well pollution prevention grouting according to the embodiment of the present invention.
Figure 9:
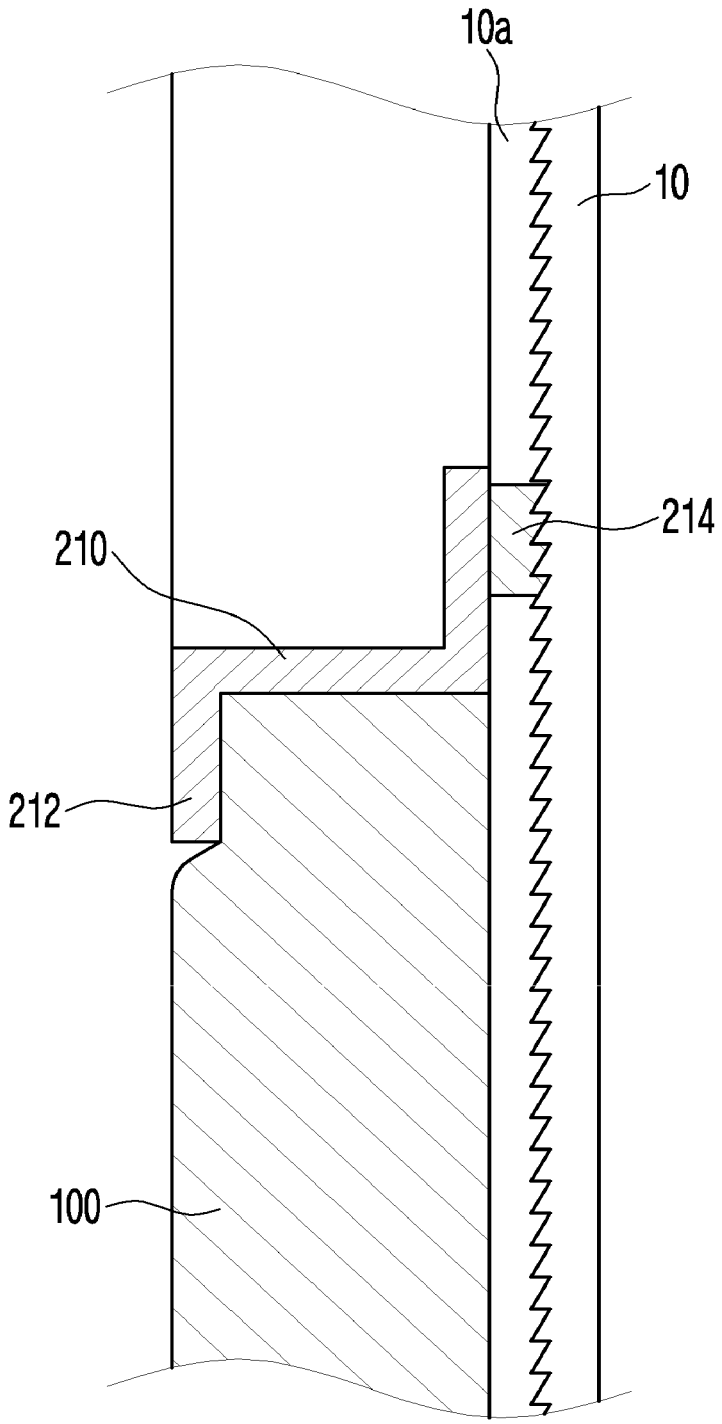
FIG. 9 is a view illustrating descending of the protrusion member of the shielding apparatus for high-depth groundwater well pollution prevention grouting according to the embodiment of the present invention.

Hereinafter, FIG. 8 is a view illustrating rail coupling a groove member and a protrusion member of the shielding apparatus for high-depth groundwater well pollution prevention grouting according to the embodiment of the present invention and FIG. 9 is a view illustrating descending of the protrusion member of the shielding apparatus for high-depth groundwater well pollution prevention grouting according to the embodiment of the present invention.

As illustrated in FIG. 8, in the shielding apparatus for high-depth groundwater well pollution prevention grouting according to the present embodiment, the grouting casing 10 includes a plurality of groove members **10*a* formed along the outer circumferential surface facing the pressing plate 210**.

Further, the pressing plate 210 may include protrusion members 214 to be inserted into the groove members **10*a*, and accordingly, the protrusion member 214 is rail-engaged with the inside of the groove member 10*a*** to descend.

That is, the groove members 10*a* formed at predetermined intervals are provided on the outer circumferential surface of the grouting casing 10, and a plurality of protrusion members 214 formed at intervals corresponding to the intervals of the groove members 10*a* are provided on the inner circumferential surface of the pressing plate 210. Accordingly, the protrusion member 214 is rail-engaged with the inside of the groove member 10*a* to descend in a longitudinal direction of the groove member 10*a*, thereby guiding the pressing plate 210 to descend while easily maintaining the same horizontal state during the operation of the cylinder 220 by the water pressure, that is, the descending of the pressing plate 210.

In addition, as described above, since the plurality of protrusion members 214 are rail-engaged to the inside of the plurality of groove members 10*a*, except for a case where all of the protrusion members 214 ascend together at the same time, when only one protrusion member 214 ascends, other protrusion members 214 are engaged on the groove members 10*a* through the rail-engaging structure to easily block the ascending of the pressing plate 210.

Meanwhile, as illustrated in FIG. 9, the inner circumferential surface of the groove member 10*a* forming a descending section of the pressing plate 120 may be formed in the form of a ratchet gear, and the protrusion member 214 is fitted with the inner circumferential surface of the groove member 10*a* to correspond to the groove member 10*a* so as to limit the ascending of the pressing plate 210.

More specifically, the pressing plate 210 descends by the water pressure to compress the shielding portion 100, and the pressing plate 210 may ascend by the reaction or pressure due to the elasticity as the shielding portion 100 is modified, and as a result, there is a problem that the shielding effect is reduced.

To this end, the protrusion member 214 provided in the pressing plate 120 is mechanically engaged with the inside of the groove member 10*a*, in other words, fitted to the inside formed in the ratchet gear to block the ascending of the pressing plate 210, thereby primarily preventing the pressing plate 210 from ascending through the rail engaging structure and secondarily effectively preventing the pressing plate 210 from ascending due to the modification of the shielding portion 100 through the simple engaging structure of the ratchet gear.

According to the present invention, a shielding body expanded by compression for forming a barrier layer is included and the cylinder descends along the outer circumferential surface of the grouting casing by the water pressure to compress the shielding body and uniformly expand the entire part of the shielding body by expansion by the compression. As a result, it is possible to block the inflow of the polluted groundwater introduced from the upper layer of the groundwater excavation hole (a groundwater well, a groundwater quality measurement network, a geothermal soil heat exchanger excavation hole, etc.) or to enable reliable section shielding to block the polluted groundwater for the section into which turbidity or pollutants are intensively introduced by some pollution.

Further, since the shielding body made of a synthetic resin instead of a conventional expansion tube is applied to the present invention, it is possible to prevent a problem of deterioration of a shielding function due to damage such as tearing, and thus, largely improve reliability of the quality and the construction of the product.

While the present invention has been and described with reference to embodiment(s) illustrated in the drawings, the embodiment(s) are only illustrative, and it will be understood that various modifications can be made by those skilled in the art, and all or some of the described embodiment(s) may be optionally configured in combination. Accordingly, the true technical scope of the present invention should be defined by the technical spirit of the appended claims.

[Explanation of Reference Numerals and Symbols]

| | |
|---|---|
| 1: Excavation hole | 10: Grouting casing |
| 10a: Groove member | 12: Guide plate |
| 100: Shielding portion | 200: Compression portion |
| 202: Connection tube | 210: Pressing plate |
| 210a: Engaging groove | 212: Receiving member |
| 214: Protrusion member | 220: Cylinder |
| 222: Cylinder portion | 224: Piston |
| 226: Piston rod | 230: Control valve |
| 240: Guide member | 250: Fastening member |
| 300: Pressure equalization injection tube portion | 310: Water supply tube |
| 312: Check valve | 320: Air discharge tube |
| 322: Shutoff valve | 400, 400': Ascending blocking portion |
| H: Fastening hole | |

The invention claimed is:

1. A shielding apparatus for high-depth groundwater well pollution prevention grouting, the shielding apparatus comprising:

a shielding portion which is provided on the outer circumferential surface of a grouting casing installed in an excavation hole in the ground and compressed to be in close contact with a hollow wall of the excavation hole;

a compression portion which is provided on the outer circumferential surface of the grouting casing and formed to descend toward the shielding portion to compress the shielding portion into close contact with the hollow wall of the excavation hole to guide the excavation hole to be sealed, wherein the compression portion includes a plurality of cylinders;

a pressure equalization injection tube portion which is connected with the compression portion on the outer circumferential surface of the grouting casing and lowers the compression portion by water pressure generated by water through a water supply tube; and a pressing plate which is provided on the outer circumferential surface of the grouting casing so as to face an upper surface of the shielding portion and has a plurality of engaging grooves formed along an edge of the pressing plate to receive the plurality of cylinders.

2. The shielding apparatus of claim 1, wherein the compression portion includes:

a cylinder of the plurality of cylinders which is engaged with one of the plurality of engaging grooves to be connected to the pressure equalization injection tube portion and configured to lower the pressing plate by the water pressure generated by the water supplied to the pressure equalization injection tube portion.

3. The shielding apparatus of claim 2, wherein the compression portion further includes a control valve which is provided on a connection tube connecting the pressure equalization injection tube portion and the cylinder and controls the opening and closing so that the plurality of cylinders descends at the same water pressure generated by the water stored in the pressure equalization injection tube portion.

4. The shielding apparatus of claim 2, further comprising:

an ascending blocking portion which is fixedly disposed between the plurality of cylinders, the ascending blocking portion is disposed to be in contact with the upper edge of the pressing plate to block the ascending of the pressing plate.

5. The shielding apparatus of claim 4, wherein the compression portion further includes guide members on the upper portion of the pressing plate so as to be in contact with both surfaces of the ascending blocking portion to form a descending path when the pressing plate descends.

6. The shielding apparatus of claim 2, wherein the pressing plate includes a fastening hole which is provided at the edge of the position where the engaging groove is formed and formed to be engaged with the cylinder by inserting the fastening member to a side surface as a piston rod constituting the cylinder is engaged with the engaging groove.

7. The shielding apparatus of claim 2, wherein the pressing plate includes a receiving member which is formed such that the edge of the outer circumferential surface is bent downward toward the shielding portion, and formed so as to selectively receive the shielding portion therein.

8. The shielding apparatus of claim 2, wherein the grouting casing includes a plurality of groove members formed along the outer circumferential surface facing the pressing plate, and the pressing plate includes protrusion members to be inserted into the groove members so that the protrusion member is rail-engaged with the inside of the groove member to descend.

9. The shielding apparatus of claim 8, wherein the inner circumferential surface of the groove member forming a descending section of the pressing plate is formed in the form of a ratchet gear, and the protrusion member is fitted with the inner circumferential surface of the groove member so as to limit the ascending of the pressing plate.

10. The shielding apparatus of claim 1, wherein the pressure equalization injection tube portion includes an air discharge tube formed to discharge the remaining internal air to the outside before the water is supplied through the water supply tube.

11. The shielding apparatus of claim 10, wherein the air discharge tube includes a shutoff valve formed to be opened when the remaining air is discharged and selectively shut off as the water is supplied of the pressure equalization injection tube portion.

12. The shielding apparatus of claim 1, wherein the shielding portion is made of a soft rubber material so that the shape of the shielding portion is deformed as the compression portion descends to be selectively brought into close contact with the hollow wall of the excavation hole.

13. The shielding apparatus of claim 1, wherein the pressure equalization injection tube portion comprises a circular tube directly connected to the plurality of cylinders to supply water to each of the plurality of cylinders.

14. The shielding apparatus of claim 1, wherein a plurality of fastening members to engage the pressing plate to the plurality of cylinders, the plurality of fastening members positioned to correspond with the plurality of engaging grooves.

* * * * *